United States Patent [19]

Masters

[11] 3,968,663

[45] July 13, 1976

[54] KNITTING MACHINE TENSION CONTROL

[75] Inventor: Charles Ray Masters, Walhalla, S.C.

[73] Assignee: Deering Milliken Research Corporation, Spartanburg, S.C.

[22] Filed: Sept. 30, 1974

[21] Appl. No.: 510,436

[52] U.S. Cl. ..... 66/212

[51] Int. Cl.[2] ..... D04B 23/00; D04B 27/00

[58] Field of Search ..... 66/86 A, 86 H, 86 J, 66/86 L

[56] References Cited

UNITED STATES PATENTS

| | | | |
|---|---|---|---|
| 2,674,109 | 4/1954 | Bassist | 66/86 A |
| 2,871,685 | 2/1959 | Bassist | 66/86 A |
| 3,539,782 | 11/1970 | Upshur | 66/125 UX |
| 3,626,725 | 12/1971 | Fertig et al. | 66/125 R |
| 3,630,052 | 12/1971 | Fertig et al. | 66/125 R |
| 3,668,904 | 6/1972 | Murenbeeld | 66/86 A |
| 3,727,633 | 4/1973 | Bassist | 66/86 A |
| 3,780,541 | 12/1973 | Haynes | 66/86 A |
| 3,781,532 | 12/1973 | Dorsman et al. | 66/86 A UX |
| 3,858,415 | 1/1975 | Wilson et al. | 66/864 |

*Primary Examiner*—Ronald Feldbaum
*Attorney, Agent, or Firm*—Earl R. Marden

[57] ABSTRACT

Method and apparatus to measure an amount of yarn delivered from a warp beam for a knitting machine to periodically trigger a comparison device to compare the theoretical number of courses to the actual number of courses knit from the measured length of yarn to develop an electronic signal which is used to adjust the let-off control of the knitting machine.

4 Claims, 3 Drawing Figures

KNITTING MACHINE TENSION CONTROL

This invention relates generally to fabric producing machines such as looms, knitting machines, etc., and more particularly to an electronic sensing device which automatically adjusts the let-off of a knitting machine.

In most fabric producing machines the warp beam which supplies the yarn to be made into fabric is driven at a substantially constant speed relative to the speed of the fabric producing machine. This necessitates close observation of the machine by an operator since after each rotation of the warp beam the diameter of the yarn thereon being supplied to the fabric producing machine is less than the previous diameter. Therefore, the speed of the warp beam has to be periodically increased in order to maintain the supply of the correct amount of yarn to the fabric producing machine. In the past, this correction has normally been made manually by an operator after visual inspection of the machine.

The above-mentioned problem is especially critical in the knitting of elastic fabrics since slight variation in the width of the fabric causes the fabric to be graded as seconds. It can be seen that an operator cannot accurately and consistently adjust the speed of the warp beam since the observation of the machine is visual and the operator may not be present at the correct time for such adjustment since one operator works on more than one machine.

It is therefore an object of the invention to provide automatic adjustment of the speed of the yarn supplying beam of a fabric producing machine.

Other objects and advantages will become clearly apparent as the specification proceeds to describe the invention with reference to accompanying drawings, in which.

The specific disclosed embodiment is directed to a warp knitting machine producing elastic fabrics but obviously the disclosed invention is applicable to any fabric producing machine in which it is necessary to maintain the supply of a constant length of yarn to the fabric producing elements of the machine.

In warp knitting machines, especially machines producing elastic fabric, it is necessary to maintain a constant supply of a desired predetermined length of yarn during each cycle or rack of the machine. The usual, but not by any means the only, cycle in such machines is one consisting of four hundred eighty courses of fabric and is generally referred to as a "rack". Therefore, for the purpose of illustration the length of yarn for one rack is used as a standard.

Figure 1:
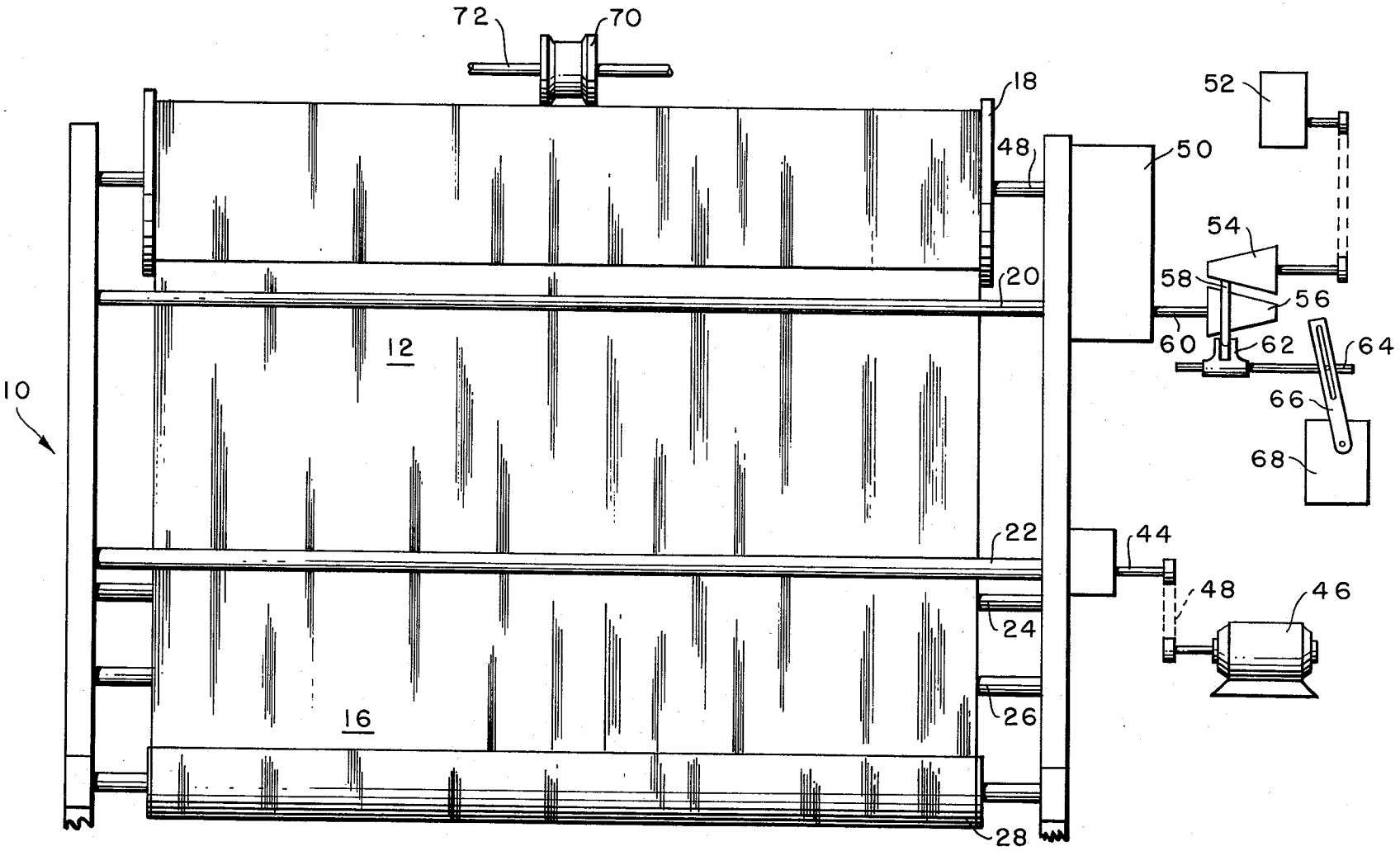
FIG. 1 is a front elevation partially schematic view of a knitting machine.

Looking now to FIGS. 1 and 2 a conventional warp knitting machine 10 is shown modified in a manner hereinafter described. In conventional manner warp yarn 12 is supplied to needle bar 14 for knitting into knit fabric 16 from warp beam 18 successively over bars 20, 22, 24 and 26. The knit fabric 16 is delivered from needle bar 14 to the cloth roll 28 by the take-up rolls 30 driven in conventional manner.

Figure 2:
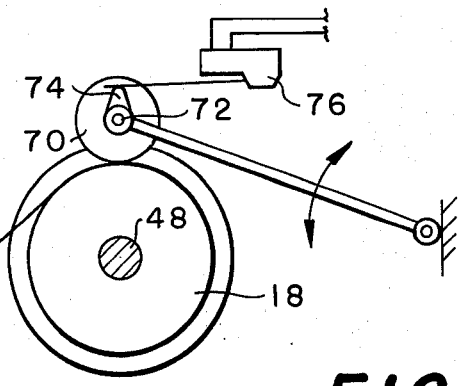
FIG. 2 is a right hand schematic elevation view of the knitting machine shown in FIG. 1
Figure 3:
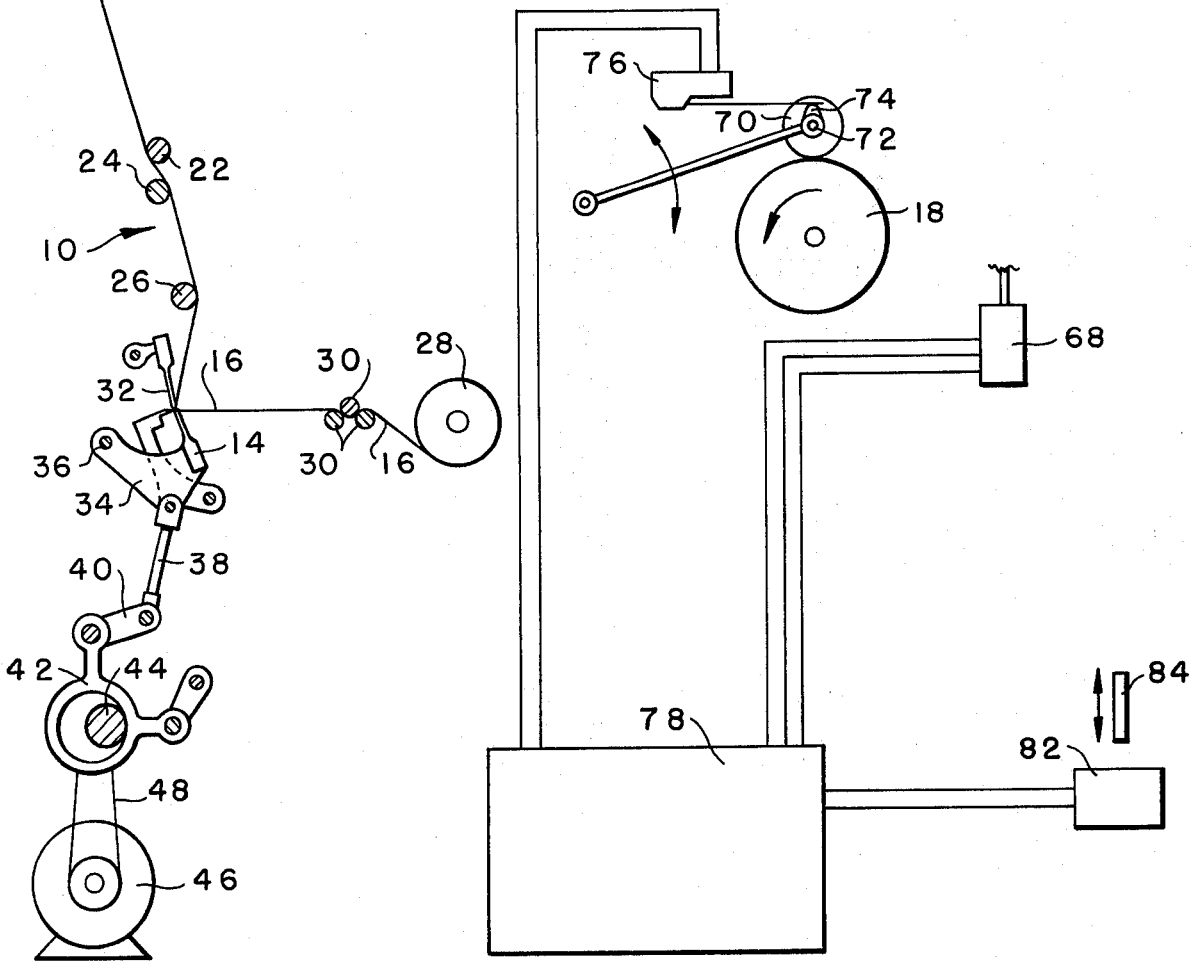
FIG. 3 is a schematic representation of the let-off comparison and control system.

Looking now at FIG. 2 the knitting operation is only schematically represented since the particular knitting operation is not part of the invention. Knitting bars 32 actuated through suitable linkage (not shown) cooperates with needle bar 14 to form the knitted fabric 16. Needle bar 14 is carried in arms 34 which are fastened in a rocker arm 36. Needle bar 14 is driven by pushrod 38 which is connnected to lever 40 pivotally connected to eccentric 42 driven by shaft 44 connected to the main drive 46 through a chain member 48.

The warp beam 18 is rotatably supported on shaft 48 which is driven by worm gears (not shown) in gear box 50. The drive for the gear box 50 is from main drive 52 through the variable speed drive composed of cone 54 which drives another cone 56 through the medium of ring 58 which determines the speed of shaft 60 connected to the gear box 50. Connected to ring 58 is a sliding forked member 62 rigidly connected to shaft member 64 and having fitted therein a portion of ring 58. Shaft member 64 in turn is connected to pivotally mounted lever arm 66 the position of which is controlled by controller 68 in a manner hereinafter explained. Controller 68 can be a reversible stepping motor or any other suitable actuator. Warp beam main drive 52 can be suitably geared to drive motor 46 or be a separate drive member.

To produce a certain desired effect a person versed in the art of knitting can select the proper knit construction encompassing the desired yarns and stitch construction and with this construction in mind can provide the theoretical length of yarn required to knit one rack. Stated another way, the number of courses of yarn knit from a certain length of yarn can be figured to provide the desired fabric. This figure (number of courses knitted per given length of yarn) is used in the herein disclosed invention. To this end a roller 70 of a predetermined diameter is mounted on a floating shaft 72 so that the roller 70 is rotated by the rotation of the warp beam 18. Fixed to the shaft 72 is a cam 74 which opens and closes a microswitch 76 to send a pulse to the commercially available pre-settable counter 78. A second pulse or series of pulses is delivered to the counter 78 by the magnetic pickup unit 82 which pulses the counter each time the yarn guide bar (not shown) is reciprocated in and out to bring the magnet 84 in proximity to the pick-up unit 82. Preferably, the magnet 84 is mounted on the end of one of the vertical connecting rods which interconnects the drive shaft of the knitting machine to the conventional guide bar moving lever. The output of the counter 78 is electronically connected to the reversing controller 68 to adjust the let-off control for the warp beam 18.

OPERATION

As discussed previously the theoretical number of courses of yarn for a given length of a desired fabric construction can be computed. For the role of convenience, the circumference of the roll 70 is used as the measured reference point so the course count will be compared on the completion of or every other revolution of the roll 70. Using the circumferential length of the roll 70 and figuring the theoretical number of courses to be knit from such a length of yarn the counter 78 is pre-set to the computed figure. Since each complete reciprocation of the knitting machine guide bars indicates the actual knitting of one course of fabric each pick-up of the magnet 84 by the pick-up unit 82 indicates one complete course of fabric has been knit. This information is pulsed into the counter 78, added and accumulated until the counter 78 receives a pulse or signal when the microswitch 76 is actuated. In each rotation of the cam 74 the switch 76 is actuated to pulse the counter 78. When the counter 78 is pulsed it automatically compares the pre-set course count to the actual accumulated course count, puts out a signal to the controller and re-sets to zero for the next comparison of course count. It should be noted that the counter 78 and the reversing controller 68 are interconnected by a three wire system with one of the wires being the ground wire while one or the other of the wires is transmitting a signal to the controller 68 to cause the ring to move either to the right or to the left to either increase or decrease the speed of the warp beam through the gear box 50. If the theoretical number of courses is greater than the actual number of courses the ring 58 (FIG. 1) will be moved to the left to slow the rotation of the warp beam to allow the machine time to add some courses from the same amount of yarn. Consequently, if the theoretical number of courses is less than the actual number of courses knit, the ring 58 will be moved to the right to increase the rotation of the warp beam to decrease the number of courses produced in the knitted fabric per given length of yarn.

It is obvious that a system has been provided that automatically adjusts the speed of the yarn supply in response to the number of courses of fabric being knit from the yarn.

Although the preferred embodiment of the invention has been described specifically, it is contemplated that changes may be made without departing from the scope or spirit of the invention and it is therefore desired that the invention be limited only by the scope of the claims.

That which is claimed is:

1. The method of automatically adjusting the warp beam let-off mechanism of a knitting machine having at least one guide bar comprising the steps of: supplying warp yarns from the warp beam to a plurality of knitting needles at a substantially constant speed, providing a comparing course counter, pre-setting the course counter to a pre-determined number, counting the number of courses of fabric being knit and accumulating the number counted on the course counter, measuring the length of yarn being supplied to the knitting needles and after the supply of a pre-determined length actuating the course counter to compare the pre-determined number of course counts to the accumulated course counts to obtain a differential course count and using the differential course count to automatically adjust the let-off mechanism to vary the speed of the warp beam.

2. The method of claim 1 wherein the length of yarn measured is measured on the warp beam.

3. An improved warp knitting machine comprising: a warp beam having warp yarn thereon, a plurality of knitting needle means supplying yarn from said warp beam to said plurality of needles, means rotating said warp beam at pre-determined speed to deliver warp yarns to said knitting needles, means actuating said knitting needles to knit said warp yarn into knit fabric, means to take-up the knit fabric, means operably associated with said warp beam rotating means to adjust the speed of rotation of said warp beam, a pre-settable course counter means operably associated with said knitting machine to compare a pre-determined course count against an actual course, means to count the number of courses being knit and to supply such number to said course counter and means operably associated with said warp beam to actuate said course counter when said warp beam has rotated a pre-determined distance to cause said course counter to automatically cause said warp beam speed adjustment means to adjust the speed of said warp beam in accordance with the difference between the pre-determined pre-set course count and the actual course count.

4. The machine of claim 3 wherein said means operably associated with said warp beam to actuate said course counter includes a roll member floating on and being driven by said warp beam.

* * * * *